US005882133A

United States Patent [19]

Chao et al.

[11] Patent Number: 5,882,133

[45] Date of Patent: Mar. 16, 1999

[54] GLUE APPLICATOR FOR LAMINATE FLOORING

[75] Inventors: Tien-Chieh Chao, Round Rock; Thomas J. Nelson, Belton; Joseph A. Ingriola, Temple, all of Tex.

[73] Assignee: Premark RWP Holdings, Inc., Wilmington, Del.

[21] Appl. No.: 740,807

[22] Filed: Nov. 1, 1996

[51] Int. Cl.[6] ..... B05C 17/005

[52] U.S. Cl. ..... 401/266; 401/5; 401/193

[58] Field of Search ..... 401/5, 193, 266

[56] References Cited

U.S. PATENT DOCUMENTS

| | | | |
|---|---|---|---|
| 3,058,632 | 10/1962 | Stremmel | 401/266 X |
| 3,217,932 | 11/1965 | Steiner . | |
| 3,279,971 | 10/1966 | Gardener | 401/266 |
| 3,352,336 | 11/1967 | Smith . | |
| 3,589,820 | 6/1971 | Ward | 401/193 X |
| 5,017,113 | 5/1991 | Heaton et al. . | |

FOREIGN PATENT DOCUMENTS

| | | | |
|---|---|---|---|
| 835 945 | 4/1952 | Germany . | |
| 33 31 739 | 3/1985 | Germany . | |
| 1 371 662 | 10/1974 | United Kingdom . | |
| 1371662 | 10/1974 | United Kingdom | 401/193 |
| 1 464 423 | 2/1977 | United Kingdom . | |

*Primary Examiner*—Steven A. Bratlie
*Attorney, Agent, or Firm*—J.M. (Mark) Gilbreth; Robert W. Strozier; Gilbert & Strozier, P.C.

[57] ABSTRACT

A glue applicator for the installation of laminate flooring on subfloors has three laterally spaced nozzles for applying separate beads of glue onto the back of a plank of laminate flooring. Two nozzles are spaced for applying separate beads of glue along the lateral edges of a plank, the third nozzle is spaced for applying beads of glue through the center of the plank. Flanges on the sides of the glue applicator position the beads of glue on the back of a plank of laminate flooring and standoff flanges hold the nozzles above the back of the plank a sufficient distance for assuring that the glue applicator of this invention does not smear the beads.

4 Claims, 1 Drawing Sheet

GLUE APPLICATOR FOR LAMINATE FLOORING

BACKGROUND OF THE INVENTION

1. Field of the Invention

This invention relates to a glue applicator for laminate flooring.

2. Description of the Related Art

Commercially available laminate flooring generally includes a wear surface glued to a substrate. The wear surface generally is high-wear resistant decorative laminate. The substrate generally is fiber board or particle board. Each piece of laminate flooring generally has a groove along one end and one side suitable for joining with a tongue along one side or end of an adjacent piece of laminate flooring. Laminate flooring is commercially available as planks and as tile. The planks are 46.5 inches long and 7.75 inches wide. The tiles are 15.5 inches square.

Laminate flooring is commercially installed over a pad. There is a need for installing laminate flooring by gluing it to a subfloor.

SUMMARY OF THE INVENTION

The glue applicator of this invention was developed for the installation of laminate flooring on subfloors. It has three laterally spaced nozzles for applying separate beads of glue onto the back of a plank of laminate flooring. Two nozzles are spaced for applying separate beads of glue along the lateral edges of a plank, the third nozzle is spaced for applying a bead of glue through the center of the plank. The nozzles for applying separate beads of glue along the lateral edges of a plank are sized and spaced for applying beads of glue that will bond the plank to the subfloor at its edges and such that glue will not flow beyond the edge of the plank. The nozzle for applying a bead of glue through the center of the plank is sized for applying a bead of glue that will bond the center of the plank to the subfloor.

Alignment flanges on the sides of the glue applicator position the beads of glue on the back of a plank of laminate flooring and standoff flanges hold the nozzles above the back of the plank a sufficient distance for assuring that the glue applicator of this invention does not smear the beads. The standoff flanges are rounded to accommodate any changes in the angle that the glue applicator is held with respect to the back of the plank without smearing the beads.

The nozzles can be fed from a hemisphere shaped end of a glue conduit.

A slot in a connecting flange can aid in attaching the glue applicator to a pressurized apparatus.

DETAILED DESCRIPTION OF THE INVENTION

Figure 1:
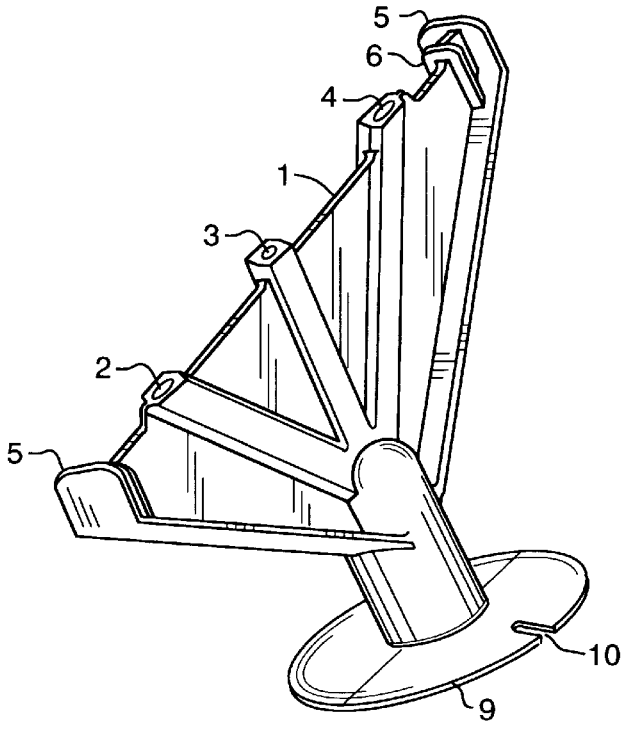
FIG. 1 is a perspective view of the glue applicator of the present invention.
Figure 2:
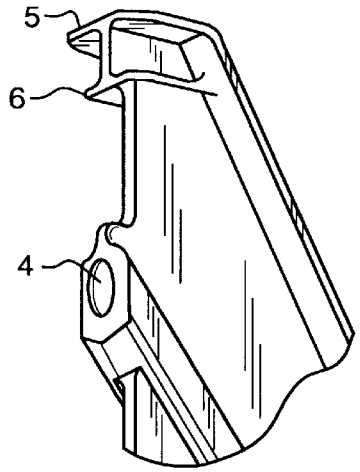
FIG. 2 is an enlarged perspective view of features of the glue applicator shown on FIG. 1.
Figure 3:
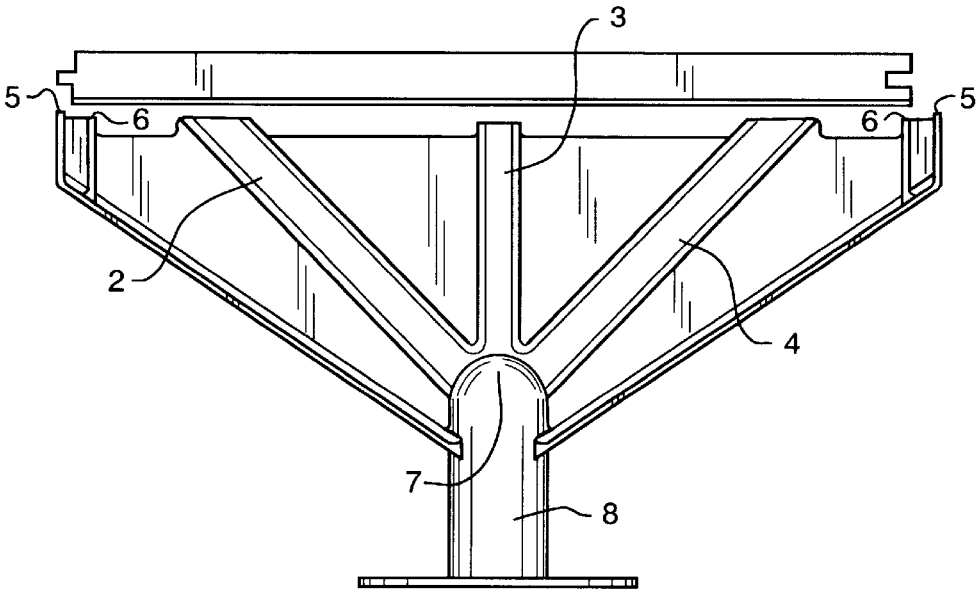
FIG. 3 is a cross section view of the glue applicator of this invention showing internal features.

The glue applicator (1) of this invention comprises three laterally spaced nozzles (2–4) for applying separate beads of glue onto the back of a plank of laminate flooring. Two nozzles are spaced (2 and 4) for applying separate beads of glue along the lateral edges of a plank. The third nozzle is spaced for applying a bead of glue through the center of the plank. The nozzles for applying separate beads of glue along the lateral edges of a plank are sized and spaced for applying beads of glue that will bond the plank to the subfloor at its edges. Additionally, the nozzles for applying separate beads of glue along the lateral edges of a plank are sized and spaced such that glue will not flow beyond the edge of the plank. The nozzle for applying a bead of glue through the center of the plank is sized for applying a bead of glue that will bond the center of the plank to the subfloor.

Alignment flanges (5) on the sides of the glue applicator assist in positioning the beads of glue on the back of a plank of laminate flooring. Standoff flanges (6) hold the nozzles (2–4) above the back of the plank a sufficient distance for assuring that the glue applicator of this invention does not smear the beads. Standoff flanges are rounded to accommodate any change in the angle that the glue applicator is held with respect to the back of the plank without smearing the beads.

Glue for affixing laminate flooring to subfloors is viscous. Therefore it has been discovered that the nozzles (2–4) need to be fed through a hemisphere shaped end (7) of a glue conduit (8). This aids in controlling the size of the beads of glue that will be applied to the back of a plank. Additionally, the diameter of the nozzle for applying glue to the center of a plank is smaller than the size of the nozzles for applying glue along the edges. This is necessary due to the differences in the lengths of these nozzles.

The glue applicator of this invention is used with a pressurized apparatus for holding tubes of glue. The apparatus for holding the tube of glue is shaped sheet metal with a flange for retaining the nozzle end of the tube of glue. A connecting flange (9) at the base of the glue applicator is provided for attaching it inside the flange of the pressurized apparatus for retaining the nozzle end of a glue tube. A slot (10) in the connecting flange (9) allows for the attachment of the glue applicator to the pressurized apparatus. The glue applicator is attached by sliding a portion of the connecting flange, at the slot (10), inside the flange for retaining the tube of glue and twisting the glue applicator. The connecting flange (9) seats between the flange for retaining the tube of glue and the end of the tube of glue. The nozzle on the end of the tube of glue is cut off and the tube of glue is seated on the glue applicator. The internal diameter of the glue conduit and the external diameter of the nozzle on the tube of glue are of sufficiently the same diameter for providing a seal. Thereby, glue exiting the nozzle on the end of the tube of glue will move through the nozzles (2–4) of the glue applicator.

A specific embodiment of this invention for applying three beads of glue on the back of a laminate flooring plank that is 7.75 inches has the following dimensions determined by measuring the embodiment. The glue that will be applied with this embodiment has a viscosity at room ambient temperature of about 170,000 centipoise. Its center nozzle (3) is round and has a diameter of about 0.180 inches and length of about 1.70 inches. Its side nozzles (2 and 4) are oblong and are about 0.319 inches across in their long dimension and are about 0.195 inches across in their short dimension and lengths of about 2.83 inches. The side nozzles (2 and 4) are spaced about 1.26 inches from the inside of the alignment flanges (5). The center nozzle (3) is spaced about 2.237 inches from the side nozzles (2 and 4). The standoff from the top of the nozzles (2–4) top of the standoff flange (6) is about 0.1925 inches. The glue conduit (8) has an internal diameter of about 0.6785 inches and a length along the cylindrical portion of the glue conduit of about 1.325 inches.

The glue applicator is made by molding rigid synthetic resin. The selection of suitable materials, methods and equipment for extrusion molding the glue applicator of this invention are known to those skilled in the art of making molded parts.

This glue applicator is also useful in applying beads of glue on the back of laminate flooring tiles that have twice the width of laminate flooring planks. An alignment flange is used along a side of the tile for positioning three beads of glue through one half of the back of the tile. An alignment flange is then used along the opposite side of the tile for positioning three more beads of glue through the other half of the back of the tile.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty that reside in the present invention, including all features that would be treated as equivalents thereof by those skilled the art to which this invention pertains.

I claim:

1. A glue applicator for the installation of laminate flooring on subfloor, comprising:

three laterally spaced nozzles for applying separate beads of glue onto the back of a plank of laminate flooring, two nozzles are spaced for applying separate beads of glue along the lateral edges of a plank, the third nozzle is spaced for applying a bead of glue through the center of the plank, the nozzles for applying separate beads of glue along the lateral edges of the plank are sized and spaced for applying beads of glue that will bond the plank to the subfloor at its edges and such that glue will not flow beyond the edge of the plank, the nozzle for applying a bead of glue through the center of the plank is sized for applying a bead of glue that will bond the center of the plank to the subfloor;

alignment flanges on the sides of the glue applicator for positioning the beads of glue on the back of a plank of laminate flooring; and standoff flanges for holding the nozzles above the back of the plank a sufficient distance to assure that the glue applicator does not smear beads of glue as they are being applied to the back of a plank, the standoff flanges are rounded to accommodate any change to the angle that the glue applicator is held with respect to the back of the plank without smearing the beads.

2. The glue applicator for the installation of laminate flooring on subfloor of claim 1, wherein the nozzles are fed from a hemisphere shaped end of a glue conduit.

3. The glue applicator for the installation of laminate flooring on subfloor of claim 1, wherein a slot in a connecting flange permits the attachment of the glue applicator to a pressurized apparatus.

4. The glue applicator of claim 1, wherein the two nozzles each have a first nozzle diameter, and the third nozzle has a second nozzle diameter, and wherein the first nozzle diameter is greater than the second nozzle diameter.

* * * * *